United States Patent [19]

Ridings et al.

[11] Patent Number: 4,941,483

[45] Date of Patent: Jul. 17, 1990

[54] AEROSOL DELIVERY ARTICLE

[75] Inventors: Henry T. Ridings, Lewisville; Chandra K. Banerjee, Pfafftown, both of N.C.

[73] Assignee: R. J. Reynolds Tobacco Company, Winston-Salem, N.C.

[21] Appl. No.: 410,191

[22] Filed: Sep. 18, 1989

[51] Int. Cl.[5] ..... A24D 1/00; A24D 1/18

[52] U.S. Cl. ..... 131/194; 131/271; 131/273; 131/360; 128/200.14

[58] Field of Search ..... 131/194, 270, 271, 273, 131/360, 359; 128/200.14

[56] References Cited

U.S. PATENT DOCUMENTS 2,104,266 1/1938 McCormick .
3,258,015 6/1966 Ellis et al. .
3,683,936 8/1972 O'Neil, Jr. .
4,149,548 4/1979 Bradshaw .
4,284,089 8/1981 Ray .
4,393,884 7/1983 Jacobs .
4,774,971 10/1988 Vieten .

FOREIGN PATENT DOCUMENTS 276250 6/1967 Australia .
86/02528 5/1986 PCT Int'l Appl. .

*Primary Examiner*—V. Millin

[57] ABSTRACT

An aerosol delivery article provides flavor or a dose of a drug by heating a flavor or a drug, but not burning any material. A heat source which includes granular magnesium, granular iron, and finely divided cellulose generates heat upon contact thereof with an aqueous solution of potassium chloride. The heat source is in a heat exchange relationship with the flavor or drug. Heat generated by the heat source heats the flavor or drug in a controlled manner. The flavor or drug volatilizes and is drawn into the mouth of the user of the article. Typical heat sources heat the flavor or drug to a temperature within about 70° C. to about 180° C. for 4 to 8 minutes.

23 Claims, 2 Drawing Sheets

AEROSOL DELIVERY ARTICLE

BACKGROUND OF THE INVENTION

The present invention relates to aerosol delivery articles, and in particular, to articles which employ a relatively low temperature heat source to volatilize a flavor and/or drug for delivery.

Over the years, there have been proposed numerous smoking products, flavor generators and medicinal inhalers which utilize various forms of energy to vaporize or heat a volatile material for delivery to the mouth of the user.

U.S. Pat. No. 2,104,266 to McCormick proposed an article having a pipe bowl or cigarette holder which included an electrical resistance coil. Prior to use of the article, the pipe bowl was filled with tobacco or the holder was fitted with a cigarette. Current then was passed through the resistance coil. Heat produced by the resistance coil was transmitted to the tobacco in the bowl or holder, resulting in the volatilization of various ingredients from the tobacco.

U.S. Pat. No. 3,258,015 and Australian Patent No. 276,250 to Ellis et al proposed, among other embodiments, a smoking article having cut or shredded tobacco mixed with a pyrophorous material such as finely divided aluminum hydride, boron hydride, calcium oxide or fully activated molecular sieves. In use, one end of the article was dipped in water, causing the pyrophorous material to generate heat which reportedly heated the tobacco to a temperature between 200° C. and 400° C. to cause the tobacco to release volatilizable materials. Ellis et al also proposed a smoking article including cut or shredded tobacco separated from a sealed pyrophorous material such as finely divided metallic particles. In use, the metallic particles were exposed to air to generate heat which reportedly heated the tobacco to a temperature between 200° C. and 400° C. to release aerosol forming materials from the tobacco.

PCT Publication No. WO 86/02528 to Nilsson et al proposed an article similar to that described by McCormick. Nilsson et al proposed an article for releasing volatiles from a tobacco material which had been treated with an aqueous solution of sodium carbonate. The article resembled a cigarette holder and reportedly included a battery operated heating coil to heat an untipped cigarette inserted therein. Air drawn through the device reportedly was subjected to elevated temperatures below the combustion temperature of tobacco and reportedly liberated tobacco flavors from the treated tobacco contained therein. Nilsson et al also proposed an alternate source of heat whereby two liquids were mixed to produce heat.

Despite many years of interest and effort, none of the foregoing non-combustion articles has ever realized any significant commercial success, and it is believed that none has ever been widely marketed. Moreover, it is believed that none of the foregoing noncombustion articles is capable of adequately providing the user with acceptable flavor or drug delivery.

Thus, it would be desirable to provide an aerosol delivery article which utilizes non-combustion energy and which is capable of providing acceptable quantities of pleasant testing vapor and/or drug in vapor form over at least 6 to 10 puffs.

SUMMARY OF THE INVENTION

The present invention relates to aerosol delivery articles which normally employ a non-combustion heat source to provide an aerosol. Articles of the present invention do not burn any materials, and hence do not produce any combustion or pyrolysis products including carbon monoxide. Preferred articles of the present invention produce controlled amounts of volatilized flavor and/or drug that do not volatilize to any significant degree under ambient conditions, and such volatilized substances can be provided throughout each puff, for at least 6 to 10 puffs.

More particularly, the present invention relates to aerosol delivery articles having a low temperature heat source which generates heat in a controlled manner as a result of one or more electrochemical interactions between the components thereof. As such, the aerosol can be visible or invisible. In one aspect, the flavor or drug, which is carried by a suitable substrate, is positioned physically separate from, and in a heat exchange relationship with, the heat source. By "physically separate" is meant that the flavor or drug is not mixed with, or is not a part of, the heat source. In another aspect, the flavor or drug, which is in a relatively dry form, is mixed with the heat source.

The heat source includes at least two metallic agents which are capable of interacting electrochemically with one another upon contact with an electrolyte in a dissociated form. The metallic agents can be provided within the article in a variety of ways. For example, the metallic agents and undissociated electrolyte can be mixed within the article, and interactions therebetween can be initiated upon the introduction of a solvent for the electrolyte. Alternatively, the metallic agents can be provided within the article, and interactions therebetween can be initiated upon the introduction of an electrolyte solution.

The heat source also normally includes (i) a dispersing agent to reduce the concentration of the aforementioned metallic agents and help control (i.e., limit) the rate of heat generation during use of the heat source, and/or (ii) a phase change material which normally undergoes a reversible phase change during heat generation from a solid state to a liquid state, and back again, to initially absorb generated heat and to release that heat during the later stages of heat generation. The dispersing agent and/or the phase change material help (i) reduce the maximum temperature generated by the heat source and experienced by the flavor or drug, and (ii) prolong the life of the heat source by acting as a reservoir for the electrolytic solution, in the case of the dispersing agent, and by absorbing and releasing heat, in the case of the phase change material.

A preferred heat source is a mixture of solid components which provide the desired heat delivery upon interaction of certain components thereof with a liquid solvent, such as water. For example, a solid mixture of granular magnesium and iron particles, granular potassium chloride crystals, and finely divided cellulose can be contacted with liquid water to generate heat. Heat is generated by the exothermic hydroxylation of magnesium; and the rate of hydroxylation of the magnesium is accelerated in a controlled manner by the electrochemical interaction between magnesium and iron, which interaction is initiated when the potassium chloride electrolyte dissociates upon contact with the liquid water. The cellulose is employed as a dispersing agent to space the components of the heat source as well as to act as a reservoir for the electrolyte and solvent, and hence control the rate of the exothermic hydroxylation reaction. Highly preferred heat sources also include an amount of oxidizing agent in an amount sufficient to oxidize reaction products of the hydroxylation reaction, and hence generate a further amount of heat. An example of a suitable oxidizing agent is sodium nitrate.

Preferred heat sources generate relatively large amounts of heat to rapidly heat at least a portion of the flavor or drug to a temperature sufficient to volatilize the flavor or drug components. For example, preferred articles employ a heat source capable of heating at least a portion of the flavor or drug to above about 70° C. within about 30 seconds from the time that the heat source is activated. Preferred articles employ heat sources which avoid excessive heating of the flavor or drug and maintain the flavor or drug within a desired temperature range for about 4 to about 8 minutes. For example, it is desirable that the flavor or drug of the aerosol delivery article not exceed about 350° C., and more preferably not exceed about 200° C. during the useful life of the article. For the highly preferred articles, the heat sources thereof heat the flavor or drug components contained therein to a temperature range between about 70° C. and about 180° C., during the useful life of the article.

To use the article of the invention, the user initiates the interactions between the components of the heat source, and heat is generated. The interaction of the components of the heat source provides sufficient heat to heat the flavor or drug, and flavor or drug components are volatilized. When the user draws on the article, the volatilized flavor and/or drug components pass through the article and into the mouth of the user.

The articles of the present invention are in greater detail in the accompanying drawings and in the detailed description of the invention which follows.

DETAILED DESCRIPTION OF THE PREFERRED EMBODIMENTS

Figure 1:
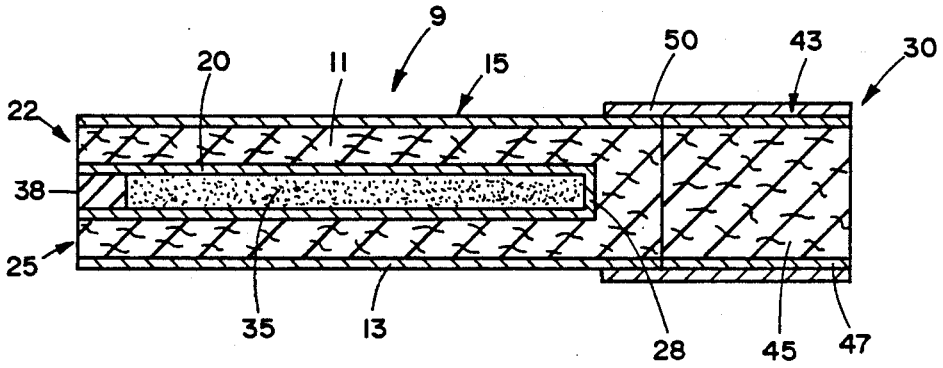

Referring to FIG. 1, aerosol delivery article 9 has an elongated, essentially cylindrical rod shape. The article 9 includes a flavor or drug carrying substrate 11 wrapped in a generally tubular outer wrap 13 such as paper, thereby forming a rod 15. An example of a suitable outer wrap is calcium carbonate and flax fiber paper available as Reference No. 719 from Kimberly-Clark Corp. Within the substrate 11 is positioned a heat resistant and electrically insulative cartridge 20 having an open end 22 near the air inlet region 25 of the article, and a sealed end 28 toward the mouth end 30 of the rod 15. The cartridge can be manufactured from a heat conductive material (e.g., aluminum), glass, a heat resistant plastic material (e.g., a polymide), or a ceramic. When the cartridge is manufactured from an electrically conductive material (e.g., aluminum or certain ceramics), it is highly preferred that the inner portion of the cartridge be composed of an electrically insulative material.

Within the cartridge 20 are positioned heat source components 35 (discussed in detail hereinafter). The heat source components 35 are maintained in place within the cartridge 20 by a plug 38, such as moisture impermeable, plasticized cellulose acetate tow having a thin surface coating of a low melting point paraffin wax. As such, there is provided a moisture barrier for storage, as well as a material having an air permeable character when the heat source generates heat. The resulting rod has the heat source embedded therein, but such that the substrate and heat source components are physically separate from one another. The rod has a length which can vary, but generally has a length of about 30 mm to about 90 mm, preferably about 40 mm to about 80 mm, and more preferably about 55 mm to about 75 mm; and a circumference of about 22 mm to about 30 mm, preferably about 24 mm to about 27 mm.

Filter element 43 is axially aligned with, and positioned in an end-to-end relationship with the rod. The filter element is employed essentially for aesthetic reasons, and preferred filter elements exhibit very low filtration efficiencies. The filter element includes a filter material 45, such as a gathered or pleated polypropylene web, and an outer wrapper 47, such as a paper plug wrap. Normally, the circumference of the filter element is similar to that of the rod, and the length ranges from about 10 mm to about 35 mm. A representative filter element can be provided as described in U.S. Pat. No. 4,807,809 to Pryor et al. The filter element 43 and rod 15 are held together using tipping paper 50. Normally, tipping paper has adhesive applied to the inner face thereof, and circumscribes the filter element and an adjacent region of the rod.

Figure 2:
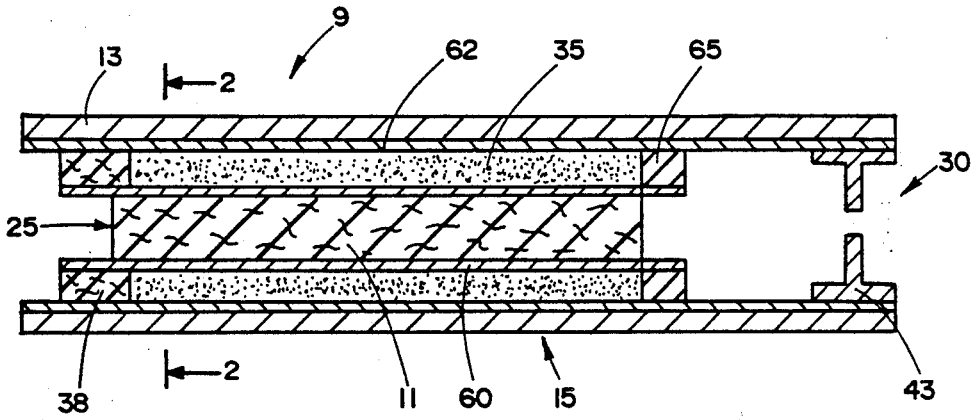
FIGS. 1, 2 and 3 are longitudinal, sectional views of representative embodiments of the present invention.
Figure 2A:
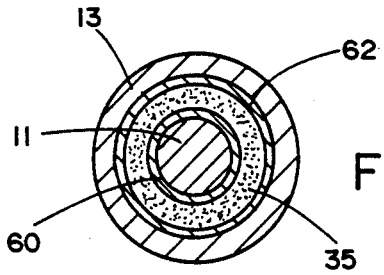
FIG. 2A is a cross-sectional view of the embodiment shown in FIG. 2 taken along lines 2—2 in FIG. 2.

Referring to FIG. 2, cigarette 9 includes an outer wrapper 13 which acts as a wrapper as well as a means for providing insulative properties. As shown in FIG. 2, the outer wrapper 13 can be a layer of thermally insulative material, such as foamed polystyrene sheet, or the like. The outer wrapper also can be a moisture-resistant paper wrapper for the article, or an insulative outer wrapper can be wrapped further with a paper wrapper (not shown).

Within the outer wrapper 13 is positioned a flavor or drug carrying substrate which extends along a portion of the longitudinal axis of the article. The substrate can have a variety of configurations, and preferably has a high surface area to maximize contact with drawn air passing therethrough. As illustrated, the substrate can be in the form of an air permeable fabric which can have a plurality of air passageways extending longitudinally therethrough or therearound.

The substrate 11 is located within tubular container 60 which can be formed from a heat resistant plastic, glass, or the like. A second tubular container 62 surrounds the first tubular container 60, and optionally the length of the article. The second tubular container can be formed from a heat resistant plastic, or the like. A barrier 65 is positioned in the annular region between tubular containers 60 and 62 near the mouthend of tubular container 60, and provides an effective air seal between the two containers in that region. The barrier can be manufactured from plastic, or the like, and can be maintained in place between the tubular containers 60 and 62 by a tight friction fit, adhesive, or other such means.

A heat source 35 (discussed in greater detail hereinafter) is positioned in the annular region between tubular containers 60 and 62. A moisture impermeable plug 38 is positioned opposite the mouthend of the article between tubular containers 60 and 62, and acts to maintain the heat source 35 in the desired position and location about the substrate 11. Plug 38 can be a fibrous material such as plasticized cellulose acetate covered with a thin coating of paraffin wax, or a resilient open cell foam material covered with a thin coating of paraffin wax. The article 9 includes a mouthend region which can include a filter element 43 or other suitable mouthend piece which provides a means for delivering flavor or drug to the mouth of the user. The filter element 43 can have a variety of configurations and can be manufactured from cellulose acetate tow, a pleated polypropylene web, molded polypropylene, or the like. Normally, the filter element 43 has a low filtration efficiency. For example, the filter can have a molded form such as a baffled configuration (as shown in FIG. 2). In particular, it is most desirable that high amounts of the volatilized flavor or drug components pass to the mouth of the user, and that low amounts of the volatilized components be deposited onto the filter. The article also includes an air inlet region 25, opposite the mouthend region, in order that drawn air can enter the article.

Figure 3:
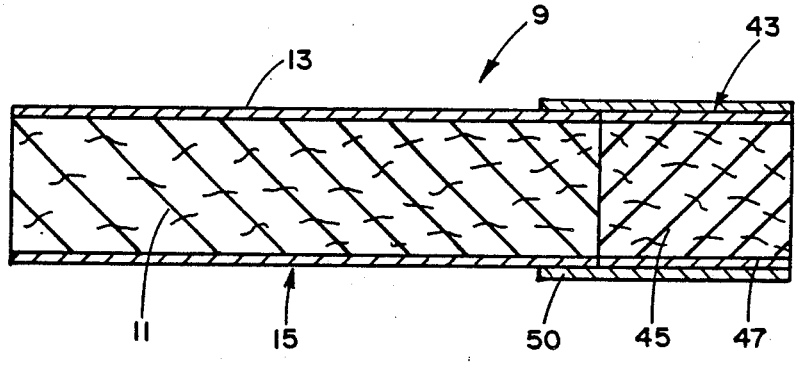

Referring to FIG. 3, the illustrated embodiment is generally similar to the embodiment shown in FIG. 1. However, for the embodiment shown in FIG. 3, the granular metallic components of the heat source, as well as other granular electrolyte components of the heat source, are mixed with a substrate 11. Normally, the substrate is an air permeable material which exhibits good heat resistance and readily carries the flavor or drug. Normally, the substrate 11 is maintained relatively dry (e.g., at a moisture level of less than about 5 weight percent).

In use, the user initiates exothermic interaction of the heat source components and the heat source generates heat. For example, an effective amount of liquid water can be injected into the heat source which includes two powdered metallic agents and solid electrolyte, so that the water can dissociate the electrolyte. Heat which results acts to warm the volatile flavor and/or drug components positioned in close proximity to the heat source so as to be in a heat exchange relationship therewith. The heat so supplied to the flavor or drug acts to volatilize volatile flavor or drug components. The volatilized components then are drawn to the mouth end region of the article and into the user's mouth. As such, the user is provided with a pleasurable flavor or a dose of drug without burning any materials. The heat source provides sufficient heat to volatilize the flavor or drug while maintaining the temperature of the flavor or drug within the desired temperature range. When heat generation is complete, the flavor or drug begins to cool and volatilization decreases. The article then is discarded or otherwise disposed of.

Heat sources of the articles of the present invention generate heat in the desired amount and at the desired rate as a result of one or more electrochemical interactions between components thereof, and not as a result of combustion of components of the heat source. As used herein, the term "combustion" relates to the oxidation of a substance to yield heat and oxides of carbon. In addition, preferred noncombustion heat sources of the present invention generate heat without the necessity of the presence of any gaseous or environmental oxygen (i.e., in the absence of atmospheric oxygen).

Preferred heat sources generate heat rapidly upon initiation of the electrochemical interaction of the components thereof. As such, heat is generated to warm the flavor or drug to a degree sufficient to volatilize an appropriate amount of components carried by the substrate rapidly after the user has initiated use of the article. Rapid heat generation also assures that sufficient volatilized components are provided during the early puffs. Typically, heat sources of the present invention include sufficient amounts of components which interact to heat at least a portion of the flavor or drug to a temperature in excess of 70° C., more preferably in excess of 80° C., within about 60 seconds, more preferably within about 30 seconds, from the time that the user has initiated use of the article.

Preferred heat sources generate heat so that the flavor or drug is heated to within a desired temperature range during the useful life of the article. For example, although it is desirable for the heat source to heat at least a portion of the flavor or drug to a temperature in excess of 70° C. very rapidly when use of the article is initiated, it is also desirable that the flavor or drug experience a temperature of less than about 350° C., preferably less than about 200° C., during the typical 4 to 8 minute life of the article. Thus, once the heat source achieves sufficient rapid heat generation to heat the flavor or drug to the desired minimum temperature, the heat source then generates heat sufficient to maintain the flavor or drug within a relatively narrow and well controlled temperature range for the remainder of the heat generation period. Typical temperature ranges for a 4 to 8 minute use period are between about 70° C. and about 180° C., more preferably between about 80° C. and about 140° C., for most articles of the present invention. Control of the maximum temperature exhibited by the heat source is desired in order to avoid thermal degradation and/or excessive, premature volatilization of the volatile components of the article.

The heat source includes at least two metallic agents which can interact electrochemically. The individual metallic agents can be pure metals or metal alloys. Examples of highly preferred metallic agents useful as heat source components include magnesium and iron. Preferred metallic agents are mechanically bonded so as to form a matrix. Such mechanical bonding can be provided by techniques such as ball milling. Preferably, the area of contact of the metallic agents is very high. Such a mixture of magnesium and iron can interact electrochemically in the presence of an aqueous electrolytic solution to accelerate the rate at which magnesium reacts exothermically with water (i.e., magnesium metal and water react to produce magnesium hydroxide, hydrogen gas and heat). Normally, each heat source comprises about 100 mg to about 400 mg of metallic agents. For heat sources which include a mixture of magnesium and iron, the amount of magnesium relative to iron within each heat source ranges from about 10:1 to about 1:1, on a weight basis.

The electrolyte can vary. Preferred electrolytes are the strong electrolytes. Examples of preferred electrolytes include potassium chloride and sodium chloride. Normally, each heat source comprises about 5 mg to about 150 mg electrolyte.

A solvent for the electrolyte is employed to dissociate the electrolyte, and hence initiate the electrochemical interaction between the metallic agents. The preferred solvent is water. The pH of the water can vary, but typically is about 6 or less. Contact of water with the components of the heat source can be achieved in a variety of ways. For example, the water can be injected into the heat source when activation of the heat source is desired. Alternatively, liquid water can be contained in a container separate, such as a rupturable capsule or microcapsule, from the other components of the heat source, and the container can be ruptured when contact of the water with the other heat source components is desired. Alternatively, water can be supplied to the remaining portion of the heat source in a controlled manner using a porous wick. Normally, each heat source is contacted with about 0.15 ml to about 0.4 ml water.

Preferred heat sources include an oxidizing agent, such as sodium nitrate or sodium nitrite. For example, for preferred heat sources which generate heat as a result of the exothermic hydroxylation of magnesium, hydrogen gas which results upon the hydroxylation of magnesium can be exothermically oxidized by a suitable oxidizing agent. Normally, each heat source comprises up to about 150 mg oxidizing agent. The oxidizing agent can be encapsulated within a polymeric material (e.g., microencapsulated using known techniques) in order to minimize contact thereof with the metallic agents (e.g., magnesium) until the desired time. For example, encapsulated oxidizing agent can increase the shelf life of the heat source; and the form of the encapsulating material then is altered to release the oxidizing agent upon experiencing heat during use of the heat source.

The heat source preferably includes a dispersing agent to provide a physical spacing of the metallic agents. Preferred dispersing agents are essentially inert with respect to the electrolyte and the metallic agents. Preferably, the dispersing agent has a normally solid form in order to (i) maintain the metallic agents in a spaced apart relationship, and (ii) act as a reservoir for the electrolyte solution. Examples of normally solid dispersing agents are porous materials including inorganic materials such as granular alumina and silica; carbonaceous materials such as finely ground graphite, activated carbons and powdered charcoal; organic materials such as wood pulp and other cellulosic materials; and the like. Generally, the normally solid dispersing agent ranges from a fine powder to a coarse grain or fibrous size; and the particle size of the dispersing agent can affect the rate of interaction of the heat generating components, and therefore the temperature and longevity of the interaction. Although less preferred, crystalline compounds having chemically bound water molecules can be employed as dispersing agents to provide a source of water for heat generation. Examples of such compounds include potassium aluminum dodecahydrate, cupric sulfate pentahydrate, and the like. Normally, each preferred heat source comprises up to about 150 mg normally solid dispersing agent.

The heat source preferably includes a phase change or heat exchanging material. Examples of such materials are sugars such as dextrose, sucrose, and the like, which change from a solid to a liquid and back again within the temperature range achieved by the heat source during use. Other phase change agents include selected waxes or mixtures of waxes. Such materials absorb heat as the interactant components interact exothermically so that the maximum temperature exhibited by the heat source is controlled. In particular, the sugars undergo a phase change from solid to liquid upon application of heat thereto, and heat is absorbed. However, after the exothermic chemical interaction of the interactive components is nearly complete and the generation of heat thereby decreases, the heat absorbed by the phase change material can be released (i.e., the phase change material changes from a liquid to a solid) thereby extending the useful life of the heat source. Phase change materials such as waxes, which have a viscous liquid form when heated, can act as dispersing agents also. Normally, each heat source comprises up to about 150 mg of phase change material.

The relative amounts of the various components of the heat source can vary, and often is dependent upon factors such as the minimum and maximum amounts of heat desired, the time period over which heat generation is desired, and the like. An example of a suitable heat source includes about 200 mg magnesium metal particles, about 50 mg iron metal particles, about 50 mg crystalline potassium chloride, about 100 mg crystalline sodium nitrate, and about 100 mg cellulose particles; which are in turn contacted with about 0.2 ml liquid water.

Drugs useful herein are those which can be administered in vapor form directly into the respiratory system of the user. As used herein, the term "drug" includes articles and substrates intended for the diagnosis, cure, mitigation, treatment or prevention of disease; and other substances and articles referred to in 21 U.S.C. 321(g)(1). Examples of suitable drugs include propranolol and octyl nitrite.

The flavor substances useful herein are those which are capable of being vaporized by the heat source and transported to the mouth of the user in vaporous form. Pleasant tasting flavors are particularly preferred. Such flavors include menthol, spearmint, peppermint, cinnamon, vanilla, chocolate, licorice, ginger, coffee, spice, strawberry, cherry, citrus, raspberry, and the like. Breath freshener flavors are particularly preferred. Concentrated flavor extracts and artificial flavors can be employed.

The flavor or drug normally is carried by a suitable substrate. For example, there is applied to the substrate (i) an amount of flavor sufficient to provide the desired flavor delivery at those temperatures provided by the heat source is applied to the substrate, and/or (ii) an amount of drug sufficient to provide the desired dose at those temperatures provided by the heat source. Suitable exemplary substrates include fibrous materials such as cotton, cellulose acetate, carbon fibers, and carbon filament yarns available as Catalogue No. CFY-0204-2 from American Kynol, Inc. Also suitable are substrates such as charcoal, pitted glass beads, alumina, and the like. Microporous materials and microspheres also can be employed. The form of the article of the present invention can be altered in order to suitably contain the individual substrates which have various forms. Normally, the substrate is such that the drug or flavor substance is carried readily by the substrate prior to use of the article, but such that the drug or flavor substance is released readily at those temperatures provided by the heat source.

If desired, substances which vaporize to yield visible aerosols can be incorporated into the article along with the flavor or drug. As such, aerosol delivery articles of the present invention can deliver essentially invisible vapors as well as a visible aerosol. For example, an effective amount of glycerin can be carried by the substrate along with the flavor or drug. Visible aerosol forming substances may be particularly desirable in order to allow the user to identify when a dose of a drug is complete.

The following examples are provided in order to further illustrate various embodiments of the invention but should not be construed as limiting the scope thereof. Unless otherwise noted, all parts and percentages are by weight.

EXAMPLE 1

A heat source is prepared as follows:

About 5 g of magnesium powder having a particle size of −40 to +80 US Mesh and about 5 g of iron powder having a particle size of −325 US Mesh are ball milled at low speed under nitrogen atmosphere for about 30 minutes. The resulting mixture of magnesium and iron is sieved through a 200 US Mesh screen, and about 6.1 g of +200 US Mesh particles are collected. The particles which are collected comprise about 5 parts magnesium and about 1 part iron. Then, about 300 mg of the collected particles are mixed with about 90 mg of crystalline potassium chloride and about 100 mg of finely powdered wood pulp. The wood pulp has a particle size of about 200 US Mesh. The resulting solid mixture is pressed under 33,000 p.s.i. using a Carver Laboratory Press to a cylindrical pellet having a diameter of about 7.6 mm and a thickness of about 10 mm.

The pellet is placed into a glass tube having one closed end. The tube has a length of about 30 mm and an inner diameter of about 12 mm. Into the tube is charged 0.25 ml water. The heat source generates heat, and reaches 70° C. in about 2 minutes and 95° C. in about 4 minutes. The heat source then continues to generate heat at a temperature between about 85° C. and about 95° C. for about 30 minutes.

EXAMPLE 2

A heat source is prepared as follows:

About 200 mg of magnesium powder having a particle size of −40 to +80 US Mesh is mixed thoroughly with about 50 mg of iron powder having a particle size of −325 US Mesh. The resulting solid mixture is pressed under 33,000 p.s.i. using a Carver Laboratory Press to provide a pellet in the form of a cylindrical tube having a length of about 0.127 inch, an outer diameter of about 0.298 inch, and an axial passageway of about 2.4 mm diameter.

The pellet is placed into the glass tube described in Example 1. Into the tube is charged 0.2 ml of a solution of 1 part potassium chloride and 4 parts water. The heat source reaches 100° C. in about 0.5 minutes. The heat source continues to generate heat at a temperature between 95° C. and 105° C. for about 8.5 minutes.

EXAMPLE 3

A heat source is prepared as follows:

About 200 mg of magnesium powder having a particle size of −40 to +80 US Mesh is mixed thoroughly with about 50 mg of iron powder having a particle size of −325 US Mesh and about 100 mg wood pulp having a particle size of about 200 US Mesh. The resulting solid mixture is pressed under 33,000 p.s.i. using a Carver Laboratory Press to provide a pellet in the form of a cylindrical tube having a length of about 3.2 mm, and an outer diameter of about 7.6 mm.

The pellet is placed into the glass tube described in Example 1. Into the tube is charged 0.2 ml of a solution of 1 part potassium chloride and 4 parts water. The heat source reaches 100° C. in about 0.5 minutes. The heat source continues to generate heat, maintaining a temperature above 70° C. for about 4 minutes. Then, about 0.2 ml of a solution of 1 part sodium nitrate and 1 part water is charged into the tube. The heat source generates more heat, and reaches a temperature of 130° C. in about 5 minutes. The heat source then maintains a temperature of above 100° C. for an additional 4.5 minutes.

What is claimed is:

1. An aerosol delivery article comprising:

(a) a volatile component including a flavor and/or a drug; and (b) a non-combustion heat source for heating the volatile component, and including (i) at least two metallic agents capable of interacting electrochemically with one another, and (ii) a normally solid dispersing agent.

2. The article of claim 1, wherein the heat source further includes a phase change material.

3. The article of claim 1 or 2, wherein the dispersing agent has a fibrous form.

4. The article of claim 1 or 2, wherein the heat source is capable of heating at least a portion of the volatile component to a temperature in excess of about 70° C. within 30 seconds from the time that exothermic electrochemical interaction of the chemical agents is initiated.

5. The article of claim 4, wherein the heat source is physically separate from the volatile component.

6. The article of claim 1 or 2, wherein the heat source is such that the volatile component is not heated to a temperature above about 350° C. during the life of the heat source.

7. The article of claim 1 or 2, wherein the heat source is such that the volatile component is not heated to a temperature above about 180° C. during the life of the heat source.

8. The article of claim 1 or 2, wherein one of the metallic agents is magnesium metal.

9. The article of claim 8, wherein the heat source is physically separate from the volatile component.

10. The article of claim 1 or 2, wherein the heat source is physically separate from the volatile component.

11. The article of claim 1 or 2, wherein the heat source further includes an electrolyte in undissociated form.

12. The article of claim 1 or 2, wherein one of the metallic agents is magnesium metal, and the heat source further includes sodium nitrate and/or sodium nitrite.

13. An aerosol delivery article comprising:

(a) a volatile component including a flavor and/or a drug; and (b) a non-combustion heat source for heating the volatile component, and including:

(i) a first metallic agent, (ii) a second metallic agent capable of interacting electrochemically with the first chemical agent, the heat source being capable of heating at least a portion of the volatile component to at least about 70° C. within 30 seconds of initiation and to a maximum temperature of less than about 350° C.

14. The article of claim 13, wherein the heat source further includes a dispersing agent.

15. The article of claim 13 or 14, wherein the heat source further includes a phase change material.

16. The article of claim 15, wherein the electrolyte includes potassium chloride.

17. The article of claim 15, wherein the heat source is physically separate from the volatile component.

18. The article of claim 13 wherein the heat source is capable of generating heat when the metallic agents are contacted with an aqueous liquid and a dissociated electrolyte.

19. The article of claim 18, wherein the heat source is physically separate from the volatile component.

20. The article of claim 13 or 14, wherein the heat source includes sodium nitrate and/or sodium nitrite.

21. The article of claim 13, wherein the first metallic agent is magnesium.

22. The article of claim 13, wherein the second metallic agent is iron.

23. The article of claim 13 or 14, wherein the heat source is physically separate from the volatile component.

* * * * *